US006695938B2

(12) United States Patent
Diede

(10) Patent No.: US 6,695,938 B2
(45) Date of Patent: Feb. 24, 2004

(54) REDUCED TOXICITY HYPERGOLIC BIPROPELLANT FUELS

(75) Inventor: Amos Diede, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 8 days.

(21) Appl. No.: 10/122,331

(22) Filed: Apr. 12, 2002

(65) Prior Publication Data

US 2003/0192633 A1 Oct. 16, 2003

(51) Int. Cl.[7] ..... C06B 47/00; D03D 23/00

(52) U.S. Cl. ..... 149/1; 149/108.6; 60/211; 60/212

(58) Field of Search ..... 149/109.4, 108.6, 149/109.2, 1; 60/211, 215

(56) References Cited

U.S. PATENT DOCUMENTS 3,552,127 A * 1/1971 Morrell ..... 60/215
5,932,837 A 8/1999 Rusek et al.
6,419,771 B1 * 7/2002 Lormand ..... 149/1

OTHER PUBLICATIONS

U.S. Patent Application, entitled, "Non–Toxic Hypergolic Miscible Fuel with Stable Storage Characteristics" Filing date: Feb. 22, 2000; Ser. No. 09/510,993; Navy Attorney Docket No. 82180.

* cited by examiner

*Primary Examiner*—Michael J. Carone
*Assistant Examiner*—Aileen B. Felton
(74) *Attorney, Agent, or Firm*—Anthony J. Serventi; Charlene A. Haley

(57) ABSTRACT

The reduced toxicity hypergolic bipropellant fuels of the present invention contain a hypergolic fuel and rocket grade hydrogen peroxide oxidizer, preferably HTP. The hypergolic fuel may be a reactive fuel or a catalytic fuel. The rocket grade hydrogen peroxide oxidizer consists of about 90 weight % to about 99 weight % $H_2O_2$, more preferably about 94 weight % to 99 weight % $H_2O_2$. However, hypergolic ignition may be attained with a $H_2O_2$ content as low as 70 weight % for some reactive fuels. The reactive fuel comprises about 6 weight % to 10 weight % reducing agent in a solvent. The catalytic fuel comprises about 6 weight % to 10 weight % catalytic agent in a solvent. The reactive fuels contain ingredients that are intrinsically reactive with rocket grade hydrogen peroxide. Upon contact with rocket grade hydrogen peroxide oxidizer, reactive fuels react vigorously with the hydrogen peroxide resulting in ignition. The catalytic fuels are produced by dissolving a catalytic agent in a solvent. The catalized fuels contain a catalyst, which, upon contact/mixing with the hydrogen peroxide, promotes rapid catalytic decomposition of the rocket grade hydrogen peroxide liberating a highly reactive form of oxygen and heat and thus resulting in subsequent ignition.

24 Claims, No Drawings

REDUCED TOXICITY HYPERGOLIC BIPROPELLANT FUELS

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefore.

BACKGROUND OF THE INVENTION

1. Field of the Invention

The present invention relates in general to reduced toxicity hypergolic bipropellants and, more particularly, to the development of new rocket fuels which are hypergolic with 70–100 weight % hydrogen peroxide. These novel bipropellant combinations are less toxic than conventional hydrazine based bipropellant systems.

2. Description of Related Art

Innovative propellants have long been used by the United States Navy for power generation, propulsion and ordnance. Prime considerations in the post World War II era have been specific impulse, volumetric energy content, surge/mobilization readiness and shipboard safety. While these parameters are still important, toxicity, personnel endangerment, environmental concerns, commercial transitions and cost have been added to the list of considerations to be taken into account.

Traditional propulsion systems requiring storable hypergolic bipropellants have used a hydrazine based fuel, such as monomethyl hydrazine, combined with nitrogen tetroxide or inhibited red fuming nitric acid. Storable hypergolic bipropellant systems using interhalogen oxidizers have also been developed and used. However, these oxidizers are highly toxic to humans and extremely reactive. As a result, these oxidizers are difficult to use and dangerous in many environments. Further, these bipropellants pose significant environmental problems and have high associated costs. When a mission requires the use of a storable hypergolic bipropellant, the choice has traditionally been limited to a hydrazine based fuel used in conjunction with $N_2O_4$ or IRFNA. These bipropellants deliver excellent performance, but they are highly reactive, toxic and/or carcinogenic substances. It is very difficult and expensive to implement these bipropellants into propulsion systems, which are able to satisfy stringent military safety requirements.

In the past, various polar and nonpolar fuels have been used with hydrogen peroxide to form usable bipropellants. However, except for a potassium cuprocyanide catalyzed hydrazine hydrate fuel discovered in the 1940's, these bipropellants were not hypergolic and required an ignition system. These non-hypergolic bipropellants are not well-suited for applications requiring pulse mode operation and/or multiple restarts. Thus, traditional hydrogen peroxide based bipropellants could not be considered as viable replacements for the more toxic hypergolic bipropellants. The potassium cuprocyanide catalyzed hydrazine hydrate fuel yielded poor performance compared to nitrogen tetroxide/monomethyl hydrazine and is also a highly toxic fuel. Thus, it has never been a serious fuel candidate.

During the last decade the, the propulsion community launched a significant research effort to develop a new, less toxic, alternative storable hypergolic bipropellants for divert and attitude control systems (DACS) that would meet shipboard requirements. Rocket grade (90–99%) hydrogen peroxide (RGHP) emerged as the liquid oxidizer of choice. The problem was a general lack of hypergolic fuels that could be used successfully with the RGHP. The first significant breakthrough was the development of a manganese acetate catalyzed methanol fuel sufficiently hypergolic to yield successful rocket engine firings.

Please refer to U.S. Pat. No. 5,932,837 issued Aug. 3, 1999 to Rusek, et al. The formulations of the U.S. Pat. No. 5,932,837 provide a reduced toxicity hypergolic miscible fuel, which can be used in combination with a rocket grade hydrogen peroxide to form a reduced toxicity miscible bipropellant with rapid ignition capabilities. In addition, the formulations of the U.S. Pat. No. 5,932,837 provide a reduced toxicity hypergolic miscible fuel containing a dissolved manganese compound, which forms a catalyst in solution. This new bipropellant is especially applicable for use in divert/attitude control systems, as well as general propulsion applications.

The concept for the formulations of the U.S. Pat. No. 5,932,837 was derived from earlier research involving catalyst-doped JP fuels, specifically JP-10. These fuels were formulated by dissolving a manganese containing organic compound in JP-10 fuel. The manganese catalyzed JP-10 fuels would initiate decomposition of the RGHP when sprayed together in a rocket motor injector, but satisfactory hypergolic ignitions were not obtained. The nonpolarity of the JP-10 and the polarity of RGHP did not enable mixing of the two propellants in a manner intimate enough or fast enough to attain the degree of hypergolicity required. In addition, theoretical energy calculations of the combination of the fuels and RGHP resulted in an optimum oxidizer to fuel ratio in the range 5:1 to 7:1. The next step was to find a catalytically active manganese, or other transition metal compound, which was soluble in a lower molecular weight polar solvent that could also serve as the fuel. The result was a hypergolic fuel composition consisting of manganese acetate tetrahydrate dissolved in methanol.

Unfortunately, the formulations of the U.S. Pat. No. 5,932,837 exhibited poor aging/storage characteristics. In time, irreversible degradation occurred in the fuel making it unacceptable for long-term tank storage. The formation of the precipitate is accelerated by heat and by the presence of water and oxygen. This is a fatal flaw for the hypergolic methanol/manganese acetate fuel described in the U.S. Pat. No. 5,932,837.

U.S. patent application Ser. No. 09/510,993, incorporated herein by reference, provides a reduced toxicity hypergolic bipropellant consisting of a modified methanol/manganese acetate fuel and rocket grade hydrogen peroxide oxidizer. The modified fuel resists the formation of precipitate over time when exposed to upper limit thermal environments. This is accomplished by buffering the pH of the fuel with acetic acid and alkali acetate and the addition of a polar amide species to increase the polarity of the solvent. Although the formulations of the Ser. No. 09/510,993 application resist the formation of precipitate better than the formulations of the U.S. Pat. No. 5,932,837, the resultant fuels do not have sufficient stability to satisfy Navy requirements. Therefore, a need in the art exists for rocket fuels with superior performance and acceptable long term tank storage capability

SUMMARY OF THE INVENTION

A preferred embodiment of the present invention provides a hypergolic fuel, either a reactive fuel or a catalytic fuel, which is used in combination with rocket grade hydrogen peroxide oxidizer to produce a reduced toxicity hypergolic bipropellant. The rocket grade hydrogen peroxide oxidizer comprises about 70 weight % to about 99 weight % of hydrogen peroxide with the balance water. The preferred hydrogen peroxide concentration is about 94 weight % to about 99 weight %. The reactive fuel is comprised of about 6 weight % to 10 weight % reducing agent dissolved in a fuel, which is also a solvent for the reducing agent. The resultant reactive fuel is intrinsically reactive with the rocket grade hydrogen peroxide oxidizer. The catalytic fuel is comprised of about 6 weight % to about 10 weight % catalytic agent dissolved in a fuel, which also serves as a solvent. The resultant catalytic fuel stimulates the decomposition of the rocket grade hydrogen peroxide oxidizer upon contact.

One object of a preferred embodiment of the present invention is to provide a reduced toxicity hypergolic fuel, which can be used in combination with rocket grade hydrogen peroxide to form a reduced toxicity hypergolic bipropellant with rapid ignition capabilities.

Another object of a preferred embodiment of the invention is to provide a reduced toxicity hypergolic fuel, which remains stable when subjected to long-term storage at maximum and minimum service temperatures.

Another object of a preferred embodiment of the invention is to provide a reduced toxicity hypergolic fuel, which is not carcinogenic and less toxic than hydrazine based fuels. In addition, it is preferred that the hypergolic fuels not be mutagens or teratogens.

A further object of a preferred embodiment of the invention is to provide a reduced toxicity hypergolic fuel formulation, which eliminates the formation of precipitates during long-term tank storage at or near the upper service temperature and provide a fuel which has an ignition delay time of less than 10 milliseconds in a low pressure environment, less than 1 psi.

A still further object of a preferred embodiment of the invention is to provide a fuel, which has a low vapor pressure/high flash point, i.e. a flash point greater than 120° F. The low vapor pressure/high flash point reduces flammability hazards and personnel exposure hazards during handling or in the event of a spill.

A still further object of a preferred embodiment of the invention is to provide a fuel, which has a freezing point lower than the freezing point of RGHP.

A still further object of a preferred embodiment of the invention is to provide a fuel, which is formulated to be miscible with water to ease firefighting complications.

A still further object of a preferred embodiment of the invention is to provide a fuel, which is chemically stable over a wide temperature range for an indefinite period of time and resists changes in chemical composition and/or the formation of residues, crystals or precipitates over time in a temperature range of −40° F. to 140° F.

A still further object of a preferred embodiment of the invention is to provide a fuel, which delivers an Isp greater than 230 seconds with 98% RGHP at a chamber pressure of 500 psi expanded to 14.7 psi.

A still further object of a preferred embodiment of the invention is to provide a fuel, which is not detonable or prone to adiabatic compression and has sufficient thermal stability so that explosions will not occur due to regenerative cooling and/or injector head thermal soak-back experienced in on-off-on operation.

BRIEF DESCRIPTION OF THE DRAWINGS

Not Applicable.

DETAILED DESCRIPTION OF THE INVENTION

The reduced toxicity hypergolic bipropellant of a preferred embodiment of the present invention contains a hypergolic fuel and rocket grade hydrogen peroxide oxidizer. The hypergolic fuel may be a reactive fuel or a catalytic fuel. The hydrogen peroxide oxidizer consists of about 70 weight % to about 99 weight % $H_2O_2$, more preferably rocket grade hydrogen peroxide which is about 90 weight % to 99 weight % $H_2O_2$, and most preferably about 94 weight % to 99 weight % $H_2O_2$. The reactive fuel is comprised of about 6 weight % to 10 weight % reducing agent dissolved in a fuel, which is also a solvent for the reducing agent. The catalytic fuel is comprised of about 6 weight % to about 10 weight % catalytic agent dissolved in a fuel, which also serves as a solvent.

The reactive fuel of a preferred embodiment of the present invention is produced by dissolving a reducing agent in a solvent that is also a fuel. Reactive fuels contain ingredients that are intrinsically reactive with rocket grade hydrogen peroxide oxidizer. Upon contact with rocket grade hydrogen peroxide oxidizer, reactive fuels react vigorously with the hydrogen peroxide resulting in ignition. The catalytic fuel is produced by dissolving a catalytic agent in a solvent that is also a fuel. Catalyzed fuels contain a catalyst, which, upon contact/mixing with the rocket grade hydrogen peroxide oxidizer, promotes rapid catalytic decomposition of the rocket grade hydrogen peroxide liberating highly reactive monotomic oxygen and heat. Hot oxygen in intimate contact with fuel results in rapid ignition.

Reactive fuels are fuels that are, or contain, strong reducing agents. Since rocket grade hydrogen peroxide is a strong oxidizing agent, an immediate and energetic reaction occurs upon contact. Rocket grade hydrogen peroxide reacts instantly and violently with most hydrides. Rocket grade hydrogen peroxide also reacts vigorously with many other substances, which have strong reducing properties. The preferred hydrides are lithium borohydride, sodium borohydride and postassium borohydride. Sodium borohydride is the most preferred reducing agent. Other applicable reducing agents include thiosulfates, thiocyanates and cyanides. Also, lithium metal dissolved in amines and/or ammonia can serve as a reactive fuel. Oraganoaluminum or other organometallics could also be used. It is recognized that a wide variety of organic solvents/fuels can be used to dissolve reducing agents to form a reactive fuel that is hypergolic with RGHP However, sodium borohydride is the preferred reactive additive.

In a preferred embodiment, 1.5 to 2.0 moles of reducing agent is dissolved in one liter of solvent. Typical solvents include tri(ethylene glycol)dimethyl ether (triglyme), diglyme, dimethylaminoethylazide and diethylenetriamine. Other amines, ethers or organic compounds resistant to reduction could be used. In a preferred embodiment, the hypergolic bipropellant of the present invention has an oxidizer-to-reactive fuel ratio in the range of about 3:1 to about 4.5:1.

In a preferred embodiment, the reactive fuel is at least partly miscible with hydrogen peroxide. Most preferably, the reactive fuel is fully miscible with hydrogen peroxide. Miscibility is advantageous so that RGHP can penetrate (intimately mix with) the reactive fuel quickly and make rapid contact with the reducing agent. If the reactive fuel is hydrophobic, rapid and smooth ignition is difficult to attain. However, an injector design with intense shear mixing may overcome this limitation.

Catalyzed fuels are fuels that contain a catalytic agent that rapidly stimulates the decomposition of hydrogen peroxide upon contact. The decomposing peroxide releases monoatomic oxygen, which exists for a brief moment until diatomic oxygen is formed. The decomposing peroxide also releases a significant amount of heat. Oxygen, heat, and fuel are the required elements for ignition. Catalysts are typically metal atoms such as, but not limited to Mn, Co, V, Ag, Cr, Pt, Ru, Pd, Fe, Ni, and Cu. Some of these elements are highly catalytic in the elemental state. Some compounds containing these elements are highly catalytic, some are moderately catalytic, and others are not catalytic to any appreciable extent. It is also recognized that some compounds that do not contain any metal atoms are catalytic. Catalytic agents include manganese acetate (anhydrous or hydrate), manganese butyrate (anhydrous or hydrate), manganese octoate, manganese acetylacetonate, cobalt octoate, cobalt butyrate (anhydrous or hydrate), cobalt acetate (anhydrous or hydrate), cobalt acetylacetonate, dicyclopentadienyliron, copper ethylhexoate and potassium dicyanocuprate. Although many transition metal containing compounds may serve as effective catalysts, the preferred catalysts are carboxylic salts of transition metal compounds.

In a preferred embodiment, the solvent, which also acts as a fuel, dissolves enough catalytic agent to assure immediate hypergolic ignition. Preferably, a minimal amount of metal catalyst is used. Preferred solvents include dimethylaminoethylazide, diethylformamide, dimethylaminoethanol, and diethylaminoethanol. Other solvents may include other amines, hydrocarbons such as JP-10, nitrated organic compounds, such as nitromethane or nitropropane, and alcohols. In a preferred embodiment, the hypergolic bipropellant of the present invention has an oxidizer-to-catalytic fuel ratio in the range of about 2.5:1 to 4.5:1.

In a preferred embodiment, the fuel is a good solvent for the catalytic substance. It is advantageous that the resultant solution is stable over the service temperature range and that no degradation occurs with time. It is advantageous that the fuel be at least partly miscible with hydrogen peroxide. Most preferably, the catalytic fuel is fully miscible with hydrogen peroxide. Again, miscibility is important so that the RGHP can penetrate (intimately mix with) the fuel to maximize contact with the dissolved catalytic material. Hydrophobic fuels greatly impede the catalytic action of the dissolved catalyst.

EXAMPLES

Fuel HF-2B

This reactive fuel consists of 2 moles of sodium borohydride dissolved in 1 liter of tri(ethylene glycol) dimethyl ether or triglyme. Hypergolicity is observed with sodium borohydride levels as low as 0.5 molar, but 2 molar solutions exhibit fast and reliable ignition under a wide range of conditions. The fuel mixture was prepared by heating the newly prepared solution (under nitrogen) to 130 degrees F. for a week. After final filtering, the fuel is water clear and stable with no observable changes (further aging) over time. This fuel was successfully fired in a rocket engine with ignition delays on the order of 1–3 milliseconds with 96% RGHP. This fuel was also successfully fired in a rocket engine using 74% hydrogen peroxide. Immediate and smooth hypergolic ignition was observed. Laboratory tests indicate that hypergolic ignition should occur with hydrogen peroxide concentrations as low as 70%. Fuel HF-2B was also fired with 96% RGHP at a pressure equivalent to 110,000 ft altitude. Ignition was still observed within 2–3 milliseconds.

The triglyme can be mixed with diglyme to lower fuel viscosity. However, as the ratio of diglyme is increased, there is also an increasing tendency for the sodium borohydride to crystallize out of solution at low temperatures. Although the sodium borohydride will readily redissolve upon warming, crystallization is undesirable. Triglyme has a low overall toxicity rating. However, triglyme is listed as a teratogen. Due to triglyme's very low vapor pressure, inhalation hazards are low.

Fuel HF-25J

This reactive fuel consists of 2 moles of sodium borohydride dissolved in 1 liter of diethylenetriamine. The fuel is prepared in the same manner as HF-2B. This fuel was also successfully fired with RGHP. Ignition delays on the order of 2–3 ms are typical with excellent pulse mode characteristics. Although diethylenetriamine is more toxic than triglyme, diethylenetriamine yields an Isp that is approximately 2% higher.

HF-57J

This catalytic fuel consists of dimethylaminoethylazide (DMAZ) catalyzed with anhydrous cobalt butyrate. DMAZ with 8% cobalt butyrate by weight was fired in a rocket motor using 96–98% hydrogen peroxide. Ignition delay on the order of 1–2 milliseconds was observed. This fuel showed no signs of degradation after environmental aging. This fuel also yielded smooth ignition time after time in pulse mode operation. Fuel HF-57J, our highest performance fuel, delivered a specific impulse approaching that of nitrogen tetroxide and monomethyl hydrazine. Cobalt butyrate hydrate could be used but the effect of the water on aging is unknown. The weight percent of cobalt butyrate could be reduced to 5–6 percent, if longer ignition delays were not objectionable. Manganese butyrate was tried and found to be a viable catalyst but the ignition delay was significantly longer. Cobalt octoate was also tried as catalyst, but the resultant fuel exhibited poor long term stability.

HF-55J

This catalytic fuel is composed of dimethylaminoethanol or diethylaminoethanol catalyzed with 8% anhydrous cobalt butyrate. This fuel yields excellent hypergolic pulse mode performance with RGHP. Cobalt butyrate hydrate could be used but the effect on aging has not been determined. Manganese butyrate was tested in lab tests and worked fine, but yielded longer ignition delays. Diethylaminoethanol could be used in place of dimethylaminoethanol as the solvent.

HF-4A

Another catalytic fuel formulation consisting of dimethylaminoethanol catalyzed with 8% cobalt octoate was successfully tested and yielded results comparable to HF-55J. Commercial cobalt octoate usually comes dissolved in mineral spirits. It is important to remove the mineral spirits by vacuum evaporation prior to use. Mn octoate also works fine but gives a longer ignition delay.

HF-16A

This catalytic fuel is a 50:50 mixture of dimethylaminoethanol and JP-10. This fuel blend dissolves cobalt octoate and forms a stable fuel, which is hypergolic with RGHP. The presence of the JP-10 increases the ignition delay time somewhat, but this is a viable hypergolic fuel. This is an example of fuel blending to obtain hypergolic fuel variants. Although JP-10 is hydrophobic, the addition of dimethylaminoethanol results in a catalyzed fuel that is at least partly miscible with RGHP. Thus the addition of dimethylaminoethanol facilitates in making a mixture containing another fuel, such as JP-10, hypergolic with RGHP. As an additional note, 8% cobalt octoate can be dissolved in many miscible organic fuel substances such as alcohols, glymes, formamides, cyclic compounds, etc to form a hypergolic fuel; however, rather long ignition delays on the order of 15 to 100 ms are usually observed. (In the case of hydrophobic fuels, many times no ignition will occur.) Apparently, these classes of fuels are not as readily oxidized by RGHP decomposition products as an amine fuel such as dimethylaminoethanol or DMAZ. However, blending these fuels with a suitable amine such as dimethylaminoethanol sensitizes the mixture to RGHP decomposition and enhances ignition.

HF-10A

This is a catalytic fuel formulation composed of dimethylaminoethanol catalyzed with 6-8% anhydrous cobalt acetate. Co acetate hydrate also works well as catalyst. Both fuel formulations passed environmental aging. Manganese acetate hydrate can be used as a catalyst, but yields longer ignition delays. Anhydrous manganese acetate also works, but results in even longer ignition delays.

Fuels HF-55J, HF-4A, and HF-10A were fired in a rocket motor using 96% RGHP with excellent results. Smooth hypergolic ignition in 2–3 milliseconds was observed with excellent pulse mode operation and excellent overall performance.

HF-35J

This catalytic fuel consists of a 50:50 mixture of diethylaminoethanol and nitromethane in which 8% cobalt octoate is dissolved. A closely related fuel using dimethylaminoethanol was fired in a rocket engine with 96% RGHP. This fuel yielded exceptionally smooth start-up and pulse mode operation with an ignition delay on the order of 3 milliseconds. This fuel has an exceptionally low O/F ratio of approx 2.6:1 with 98% hydrogen peroxide, good density, and good delivered specific impulse. We detected some instabilities with the cobalt octoate catalyzed 50:50 mixture of dimethylaminoethanol and nitromethane. The diethylaminoethanol version of this fuel seems to be stable.

Although the description above contains many specificities, these should not be construed as limiting the scope of the invention but as merely providing an illustration of the presently preferred embodiment of the invention. Thus the scope of this invention should be determined by the appended claims and their legal equivalents.

What is claimed is:

1. A hypergolic bipropellant fuel comprising a reactive fuel and hydrogen peroxide oxidizer, wherein said reactive fuel comprises:

about 6 to 10 weight % reducing agent in a solvent, wherein said reducing agent is a hydride with strong reducing properties including lithium borohydride, sodium borohydride and potassium borohydride, wherein said reactive fuel reacts with said hydrogen peroxide oxidizer to produce an energetic reaction.

2. The hypergolic bipropellant fuel of claim 1, wherein said reducing agent is further selected from the group consisting of thiosulfate, thiocyanate and cyanide.

3. The hypergolic bipropellant fuel of claim 1, wherein said solvent is selected from the group consisting of tri (ethylene glycol)dimethyl ether, diglyme, diethylenetriamine, a reduction resistant organic solvent and any combination thereof.

4. The hypergolic bipropellant fuel of claim 1, wherein said hypergolic bipropellant fuel has an oxidizer-to-reactive fuel ratio in the range of about 3:1 to 4.5:1.

5. The hypergolic bipropellant fuel of claim 1, wherein hydrogen peroxide comprises about 70 weight % to about 99 weight % of said hydrogen peroxide oxidizer.

6. A hypergolic bipropellant fuel comprising a catalytic fuel and rocket grade hydrogen peroxide oxidizer, wherein said catalytic fuel comprises:

about 6 to 10 weight % catalytic agent in a solvent, wherein said catalytic fuel stimulates catalytic decomposition of said rocket grade hydrogen peroxide oxidizer and wherein said catalytic decomposition causes a release of oxygen and heat.

7. The hypergolic bipropellant fuel of claim 6, wherein said catalytic agent is a transition metal compound.

8. The hypergolic bipropellant fuel of claim 6, wherein said catalytic agent is selected from the group consisting of anhydrous manganese acetate, manganese acetate hydrate, manganese butyrate hydrate, anhydrous manganese butyrate, manganese octoate, cobalt octoate, anhydrous cobalt butyrate, cobalt butyrate hydrate, anhydrous cobalt acetate, and cobalt acetate hydrate.

9. The hypergolic bipropellant fuel of claim 6, wherein said catalytic fuel is partly miscible with hydrogen peroxide.

10. The hypergolic bipropellant fuel of claim 6, wherein said solvent is selected from the group consisting of dimethylaminoethylazide, diethylformamide, hydrocarbon-amine blends, diethylaminoethanol, dimethylaminoethanol, diethylenetriamine, alcohol/amine blends and any combination thereof.

11. The hypergolic bipropellant fuel of claim 6, wherein said hypergolic bipropellant fuel has an oxidizer-to-catalytic fuel ratio in the range of about 2.5:1 to 4.5:1.

12. The hypergolic bipropellant fuel of claim 6, wherein hydrogen peroxide comprises about 90 weight % to about 99 weight % of said rocket grade hydrogen peroxide oxidizer.

13. The hypergolic bipropellant fuel of claim 1, wherein said reactive fuel is partly miscible with hydrogen peroxide.

14. The hypergolic bipropellant fuel of claim 6, wherein said catalytic fuel is fully miscible with hydrogen peroxide.

15. The hypergolic bipropellant fuel of claim 1, wherein said reactive fuel is fully miscible with hydrogen peroxide.

16. The hypergolic bipropellant fuel of claim 6, wherein hydrogen peroxide comprises about 94 weight % to about 99 weight % of said rocket grade hydrogen peroxide oxidizer.

17. The hypergolic bipropellant fuel of claim 1, wherein hydrogen peroxide comprises about 90 weight % to about 99 weight % of said hydrogen peroxide oxidizer.

18. A hypergolic bipropellant fuel comprising a hypergolic fuel and rocket grade hydrogen peroxide oxidizer, wherein said hypergolic fuel is selected from the group consisting of a reactive fuel and a catalytic fuel.

19. The hypergolic bipropellant fuel of claim 18, said reactive fuel comprising:

about 6 to 10 weight % reducing agent in a solvent, wherein said reactive fuel combines with said rocket grade hydrogen peroxide oxidizer to produce an energetic reaction.

20. The hypergolic bipropellant fuel of claim 18, said catalytic fuel comprising:

about 6 to 10 weight % catalytic agent in a solvent, wherein said catalytic fuel stimulates catalytic decomposition of said rocket grade hydrogen peroxide oxidizer and wherein said catalytic decomposition causes a release of oxygen and heat.

21. A hypergolic bipropellant fuel comprising a reactive fuel and hydrogen peroxide oxidizer, wherein said reactive fuel comprises:

about 6 to 10 weight % reducing agent in a solvent, wherein said reducing agent is a hydride with strong reducing properties, wherein said reducing agent is selected from the group consisting of thiosulfate, thio cyanate and cyanide; and wherein said reactive fuel reacts with said hydrogen peroxide oxidizer to produce an energetic reaction.

22. The hypergolic bipropellant fuel of claim 21, wherein said solvent is selected from the group consisting of tri (ethylene glycol)dimethyl ether, diglyme, diethylenetriamine, a reduction resistant organic solvent and any combination thereof.

23. The hypergolic bipropellant fuel of claim 21, wherein said hypergolic bipropellant fuel has an oxidizer-to-reactive fuel ratio in the range of about 3:1 to 4.5:1.

24. The hypergolic bipropellant fuel of claim 21, wherein hydrogen peroxide comprises about 70 weight % to about 99 weight % of said hydrogen peroxide oxidizer.

* * * * *